United States Patent [19]

Yen

[11] Patent Number: 4,587,831

[45] Date of Patent: May 13, 1986

[54] PRESS MACHINE

[76] Inventor: Wen-Hsiung Yen, No. 14-3, La. 263, Wan Lee Rd., South District, Tainan, Taiwan

[21] Appl. No.: 736,289

[22] Filed: May 20, 1985

[51] Int. Cl.[4] ..... B21J 9/12

[52] U.S. Cl. ..... 72/453.03

[58] Field of Search ..... 72/453.03, 449, 422; 100/270

[56] References Cited

U.S. PATENT DOCUMENTS

| | | | |
|---|---|---|---|
| 1,713,974 | 5/1929 | Massey | 72/453.03 X |
| 3,427,856 | 2/1969 | Asari | 72/453.03 |
| 4,282,739 | 8/1981 | Hallenbeck | 72/449 |

*Primary Examiner*—Leon Gilden

*Attorney, Agent, or Firm*—Knobbe, Martens, Olson & Bear

[57] ABSTRACT

The invention is relative to an improved press machine which comprises a machine body, a frame, a hydraulically operating unit for raising and lowering the frame, a mechanically operating unit, a ramming means, and a slide body which are in such an arrangement that the frame can be slid up and down, and the slide body can be moved downward until it contacts with a workpiece before the ramming means delivers a blow when the frame is lowered, and can transmit the blow of the ramming means to the workpiece when the ramming means is operated.

7 Claims, 4 Drawing Figures

PRESS MACHINE

BACKGROUND OF THE INVENTION

This invention provides for an improved press machine, and particularly for a stroke controllable press machine which is suitable for processing workpiece with a variety of specifications, particularly for working used hardware.

The press machine is vital machine in modern manufacturing, and it has the advantages of punching, shearing, shaping, bending and compressing functions. However, a press machine with only a treadle drive system or a hydraulic system cannot be completely controlled when punching and is not suitable to punch differently shaped workpiece.

FIG. 1 is a front view of a prior press machine which comprises a press bed 1 which has two spaced apart upright supporting arms 11, 12; each supporting arm 11, 12 has a slide groove 13 on it, a transmitting shaft 14 mounted horizontally on the upper portion of the supporting arm 11, 12 and a flywheel 141 connected to one end of the shaft 14. The flywheel 141 can be actuated by motor 16; a crank means 142 is connected to the shaft 14 and also to a slide body 17 which can be slid up and down on the groove 13 of the supporting arm 11, 12. There is a clutch device 141*a* between the flywheel 141 and transmitting shaft 14. The clutch device 141*a* is disengaged while in a normal state and controlled by a treadle 15 so that the flywheel 141 cannot engage the shaft 14 for rotating until the treadle is pressed down. When the motor 16 is switched on, it actuates the flywheel 141 by a belt 16*a* for syncronous rotation. When an operator wishes to press a workpiece placed on the bed 1, he presses on the treadle 15 and engages the clutch 141*a* between the flywheel 141 and the shaft 14 by the clutch rod 151 to start the syncronous rotation. By means of the crank 142, the slide body 17 can be slid up and down along the slide groove 13 to perform the punching and pressing function. Because the above-described prior press machine has a punching stroke which cannot be adjusted, it is very limited in the types and sizes of workpieces that it can press, and specifications cannot be varied. For special processing of workpieces of various specifications and shapes, the prior press machine is not convenient or suitable, because it is difficult to locate a differently shaped workpieces at proper position with respect to the punch.

SUMMARY OF THE INVENTION

This invention provides an improved press machine, and particularly a stroke controllable press machine which is suitable for processing workpieces of various specification, particularly for working used hardware.

An improved press machine comprises a body with a press bed which has two spaced apart upright guide member mounted thereon. The upright members are provided with vertical first slide rails. A frame which has two legs is mounted on the bed of the body and the legs are provided with first slide grooves for engaging with the first slide rails so that the frame can be slid along the upright guide member.

There is further provided a hydraulic unit for raising and lowering the frame. The hydraulic unit can be a known reciprocating piston-type hydraulic unit. There are three treadles at the bottom part of the press machine and by operating the first and second treadles, the hydraulic unit will actuate the frame to move downward and upward. A mechanically operating unit is mounted on the frame and a ramming means is connected to the operating unit for moving upward and downward.

A slide body which is slideably mounted on the frame has a guide means at the top side thereof for guiding the ramming means. The guide means has two guide pins in the form of two bolts which are screwed to the slide body. The ramming means includes a transverse plate which has two apertures to enable the tranverse plate to be slideably sleeved on the guide pins and an intermediate opening for permitting a ramming rod to pass there through. The ramming rod has a rounded end received in a recess of a hammer head screwed to the bottom of the transverse plate. The slide body further includes two spring each of which has it one end attached to the slide body and it another end attached to the frame, and has a depression at its top surface for receiving the blow of the hammer head. The slide body also includes a slide back having ends two second slide rails which extend in two second slide grooves of two second guide member provided on the legs of the frame.

The mechanically operating unit includes a motor, two transmission wheels, a belt and a transmitting shaft mounted horizontally on the upper portion of the frame and a crank means connected to the shaft and the ramming rod. There are also provided a magnetic clutch means and a switch for controlling the clutch means. The switch is located on the frame in such a manner that it can be actuated by the slide body when the frame is sliding down and the slide body stop while contacts to the workpiece that the slide body touch and actuate the descending switch. The operating unit further includes a third treadle for controlling the clutch means.

These and other objects, features and advantages of the present invention will be more apparent in the following description of a preferred embodiment with reference to the accompanying drawings, in which:

DETAILED DESCRIPTION OF THE PREFERRED EMBODIMENT

Figure 1:
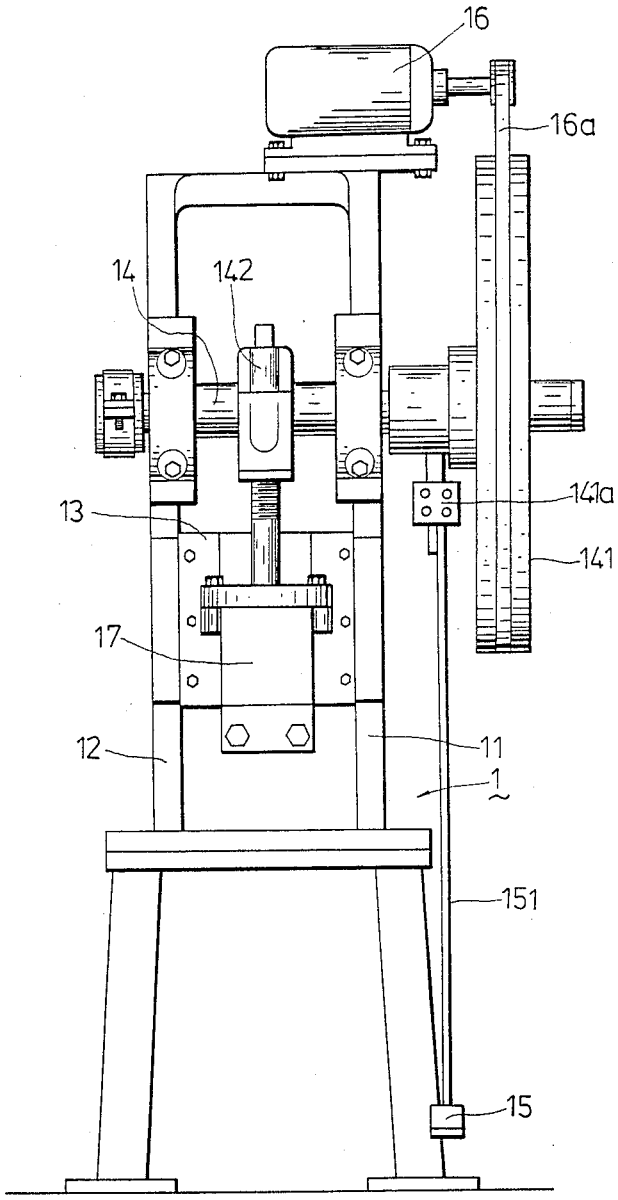
PRIOR ART FIG. 1
FIG. 1 is a front view of the prior art.
Figure 2:
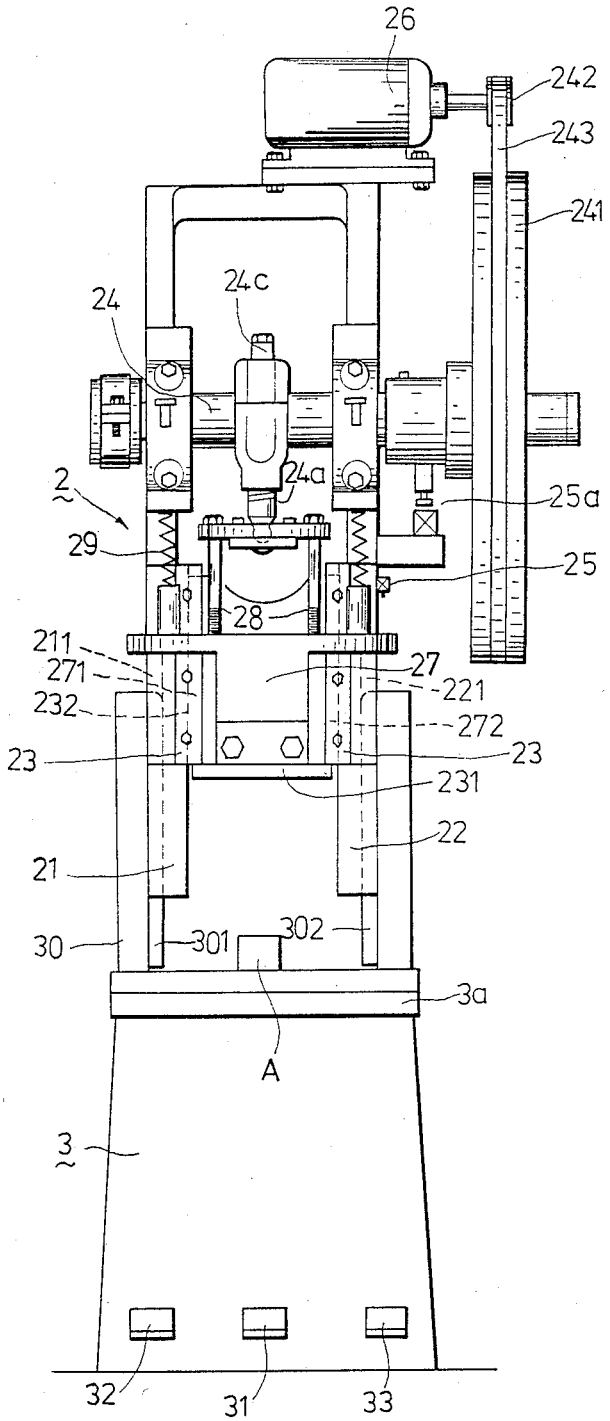
FIG. 2 is a front view of the invention.

Referring to FIG. 2, an improved press machine comprises a body 3 with a press bed 3*a* which has two spaced apart upright members 30 mounted thereon. The upright members 30 are provided with vertical first slide rails 302 and 302 respectively. A frame 2 which has two legs 21, 22 is mounted on the bed 31. The legs 21, 22 are provided with first slide grooves 211, 221 for engaging with the first slide rails 301, 302 so that the frame 2 can be slid along the upright member 30.

There is further provided a hydraulic unit {not shown in the figure} for raising and lowering the frame 2. The hydraulic unit can be a known reciprocating piston-type hydraulic unit. Since the construction for raising and lowering the frame 2 with the hydraulic unit can be accomplished by one who skilled in the art, the details thereof is not herein described. There are three treadles 31, 32 and 33, at the bottom part of the body 3 of the press machine and by operating the treadles 31 and 32, the hydraulic unit will actuate the frame 2 to move downward and upward. A mechanically operating unit is mounted on the frame 2 and a ramming means connected to the operating unit for moving upward and downward.

Figure 3:
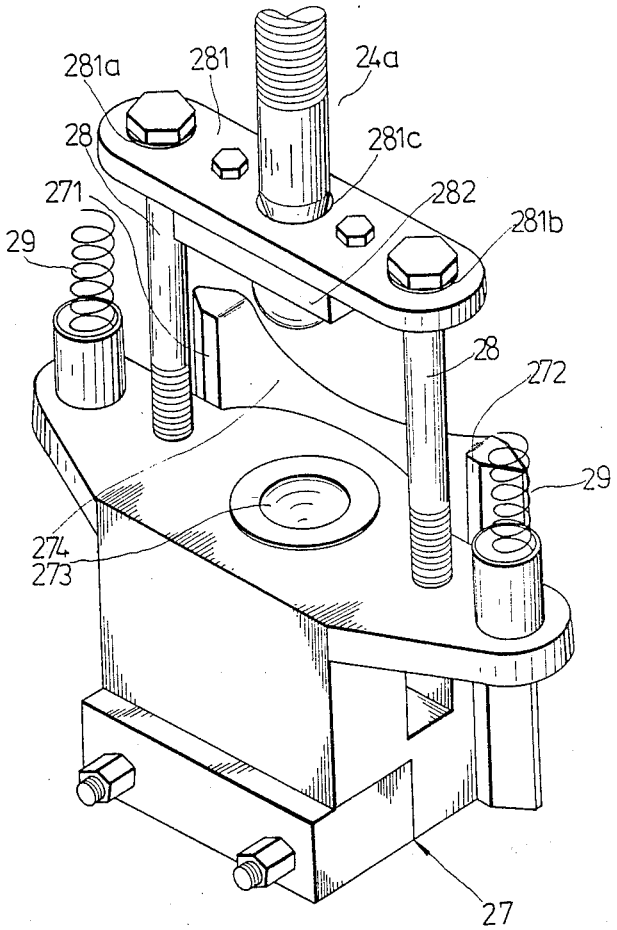
FIG. 3 is a perspective view of the slide body according to the present invention.
Figure 4:
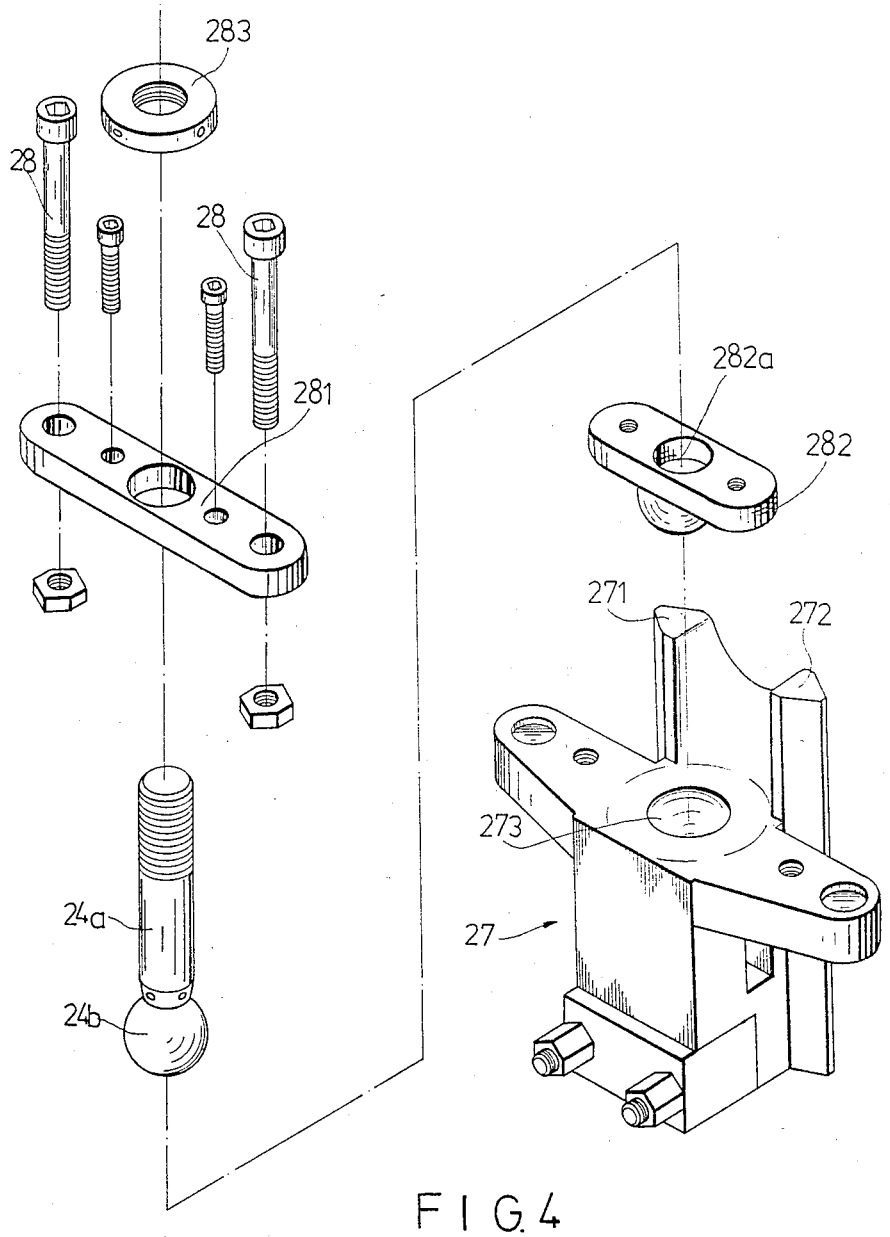
FIG. 4 is an exploded view of the slide body according to the present invention.

Referring to FIGS. 2, 3 and 4, a slide body 27 which is slideably mounted on the frame 2 has a guide means at the top side thereof for guiding the ramming means. The guide means has two guide pins 28 in the form of two bolts which are screwed to the slide body 27. The ramming means includes a transverse plate 281 which has two aperatures 281*a*, 281*b* to enable the transverse plate 281 to be slideably sleeved on the guide pins 28 and an intermediate opening 281*c* for permitting a ramming rod 24*a* to pass there through. The ramming rod 24*a* has a rounded end 24*b* received in a recess 282*a* of a hammer head 282 screwed to the bottom of the transverse plate 281. The ramming rod is then fixed to the plate 281 by a retaining ring 283 which in turn is screwed to plate 281. The slide body 27 further includes two springs 29 each of which has it one end attached to the slide body 27 and its another end attached to the frame 2 and has a depression 273 at its top surface for receiving the blow of hammer head 282. The slide body 27 also includes a slide back 274 having ends 271, 272 which extend in slide grooves 232 of two guide members 23 provided on the legs 21, 22. below the slide body 27 is further provided a bearing plate 231.

The mechanically operating unit includes a motor 26, a transmission heels 241 and 242, a belt 243, a transmitting shaft 24 mounted on the upper portion of the frame 2 and a crank means 24*c* connected to the shaft 24 and the ramming rod 24*a*. There are also provided a magnetic clutch means 25*a* and a switch 25 for controlling the clutch means 25*a*. The operating unit further includes the third treadle 33 for controlling the clutch means 25*a*.

The improved press machine of the present invention can be used for punching various shape objects stroke by stroke. When one presses on the first treadle 31, the frame 2 slides down by mean of the hydraulic unit. When the slide body 27 contacts with the workpiece A, then the movement of the slide body 27 is stopped by the workpiece A although the frame 2 slides down continuously. Because of the arrangement of the second slide grooves 232 and the second slide rails 271, 272 of the slide body 27, if the frame 2 slides downward continuously while pressing on the treadle 31, then the slide body 27 will touch and actuate the descending switch 25 so that the hydraulic unit stops lowering the frame 2 and the magnetic clutch device 25*a* is engaged to cause the hammer head 282 to deliver a punch to the slide body 27 which transmits the punch of the hammer head 282 to the workpiece A. The clutch device 25*a* will be disengaged after the punch, because the slide body 27 releases the switch 25. If one continues the abovedescribed procedure over and over, it will make the switch 25 turn on and off alternatively, and the workpieces can be fed in one after the other. Since the slide body 27 can be moved downwardly before punching, a workpiece can be permitted to be placed under the slide body 27 at a proper position before it is punched. Accordingly, the machine is suitable for working various shaped objects.

If the workpiece A needs to be punched repeatedly, one can press on the treadle 33 to cause the clutch device 25*a* to be engaged, so that the ramming rod 24*a* moves continuously.

The slide body 27 can be incorporated with the transverse plate 281 by removing the springs 29 and the guide bolts 28 and screwing the plate 281 to the slide body 27, thereby enabling the slide body 27 to move with the ramming rod 24*a*.

With the invention thus explained, it is apparent that obvious modifications and variations can be made without departing from the scope of the invention. It is therefore intended that the invention be limited only as indicated in the appended claims.

What I claim is:

1. A press machine comprising:
   - a machine body with a press bed which has two spaced apart upright guide member mounted thereon;
   - a frame having two legs which are slidably connected to said guide members respectively for moving up and down;
   - a hydraulically operating unit for raising and lowering said frame connected to said guide members;
   - a mechanically operating unit mounted on said frame;
   - a ramming means connected to said mechanically operating unit for moving upward and downward; and
   - a slide body slidably mounted on said frame between said legs and below said ramming mean, said slide body having a guide means at the top side thereof for guiding said ramming means while said ramming means is ramming said slide body, wherin said slide body can be moved downward until it contacts with a workpiece, before said ramming means delivers a blow, when said frame is lowered, and transmits the blow of said ramming means to the workpiece.

2. An improved press machine as claimed in claim 1, in which said guide means has two guide pins spacedly projected from the top side of said slide body, and said ramming means including a transverse plate portion which has two apertures to enable said plate portion to be slidably sleeved on said guide pins and a vertical ramming portion having its upper end connected to said mechanically operating unit and its lower end connected to the intermediate portion of said plate portion.

3. An improved press machine as claimed in claim 1, wherein said slide body further includes two spring members for suspending said slide body on said frame.

4. An improved press machine as claimed in claim 1, wherein said upright guide members are provided with vertical slide rails respectively and said legs are provided with slide grooves for engaging with said slide rails.

5. An improved press machine as claimed in claim 1, wherein said mechanically operating unit includes a motor, a transmission unit having a transmitting shaft and a crank means connected to said shaft and said ramming means, a magnetic clutch means and a switch for controlling said clutch means, said switch being located on said frame in such a manner that it can be actuated by said slide body when said slide body is moved upward relative to said frame.

6. An improved press machine as claimed in claim 1, wherein said mechanically operating unit further includes a treadle for controlling said clutch means.

7. An improved press machine as claimed in claim 1, wherein said hydraulically operating unit includes a first treadle for actuating said frame to move downward and a second treadle for actuating said frame to move upward.

* * * * *